US005112222A

United States Patent [19]

Flading et al.

[11] Patent Number: 5,112,222

[45] Date of Patent: May 12, 1992

[54] DEBRIS TOLERANT SEAL

[75] Inventors: Donald P. Flading, Manor; Robert S. Mavretish, New Stanton, both of Pa.

[73] Assignee: Westinghouse Electric Corporation, Pittsburgh, Pa.

[21] Appl. No.: 694,159

[22] Filed: May 1, 1991

[51] Int. Cl.[5] ..... F27B 7/24

[52] U.S. Cl. ..... 432/115; 432/242; 110/246; 277/148

[58] Field of Search ..... 432/115, 103, 242; 110/246; 277/148

[56] References Cited

U.S. PATENT DOCUMENTS

| | | | |
|---|---|---|---|
| 2,659,588 | 11/1953 | Blanchard | 432/115 |
| 3,042,389 | 7/1962 | Grieskieng | 432/115 |
| 3,940,239 | 2/1976 | Rossi et al. | 432/115 |
| 4,457,520 | 7/1984 | Grachtrup | 432/115 |
| 4,545,764 | 10/1985 | Gillies et al. | 432/115 |
| 4,932,863 | 6/1990 | Anderson | 432/115 |
| 4,961,390 | 10/1990 | Whitlow et al. | 432/103 |
| 4,961,588 | 10/1990 | Brienza | 432/115 |
| 4,993,940 | 2/1991 | McIlvaine | 432/115 |

*Primary Examiner*—Henry C. Yuen

[57] ABSTRACT

An improved debris tolerant seal for a rotary combustor is disposed on the inlet end ring header so as to extend radially inwardly therefrom and cooperates with a parallel spaced apart surface and diverging surface on an adjacent refractory ring to form a seal which will not become jammed with waste materials and allows for radial and axial thermal expansion of the rotary combustor.

5 Claims, 3 Drawing Sheets

DEBRIS TOLERANT SEAL

BACKGROUND OF THE INVENTION

The invention relates to a seal and more particularly to a debris tolerant seal disposed at the inlet end of a rotary combustor utilized to incinerate municipal solid waste.

During operation of a rotary combustor that burns municipal solid waste the combustor jams quite frequently due to waste material which includes metal objects such as bolts, pipes, universal joints and sundry other metal objects getting stuck between the rotary combustor and the stationary feed chute. The problem arises because the shroud ring is not round and is not concentric with the centerline of the combustor. The ring header is neither round, concentric nor perpendicular to the center line of the combustor. The area where the seal must be installed has a variable inside and outside diameter in both radial and axial directions and to further complicate the matter there is relative thermal axial and radial displacement in the sealing area. High temperature and a corrosive environment also add to the problem.

SUMMARY OF THE INVENTION

Among the objects of the invention may be noted the provision of a inlet end seal which prevents objects from entering the sealing area and jamming the combustor.

In general, an improved debris tolerant seal for a rotary combustor, which rotates about an inclined axis , when made in accordance with this invention, comprises a circumferential bar extending radially outwardly from a ring header and a refractory ring having a pair of outer sheathed surfaces adjacent the circumferential bar. One of the sheathed surfaces is disposed parallel to and spaced from the circumferential bar. The other sheathed surface is disposed contiguous with the one sheathed surface and inclined so as to extend radially inwardly and away from said inlet end of said combustor, whereby large pieces of debris are prevented from entering the space between the one sheathed surface and the circumferential bar. The circumferential bar has refractory material disposed on the combustor side thereof to prevent it from burning out.

BRIEF DESCRIPTION OF THE DRAWINGS

The invention as set forth in the claims will become more apparent by reading the following detailed description in conjunction with the accompanying drawings, wherein like reference numerals refer to like parts throughout the drawings and in which:

DESCRIPTION OF THE PREFERRED EMBODIMENT

Figure 1:
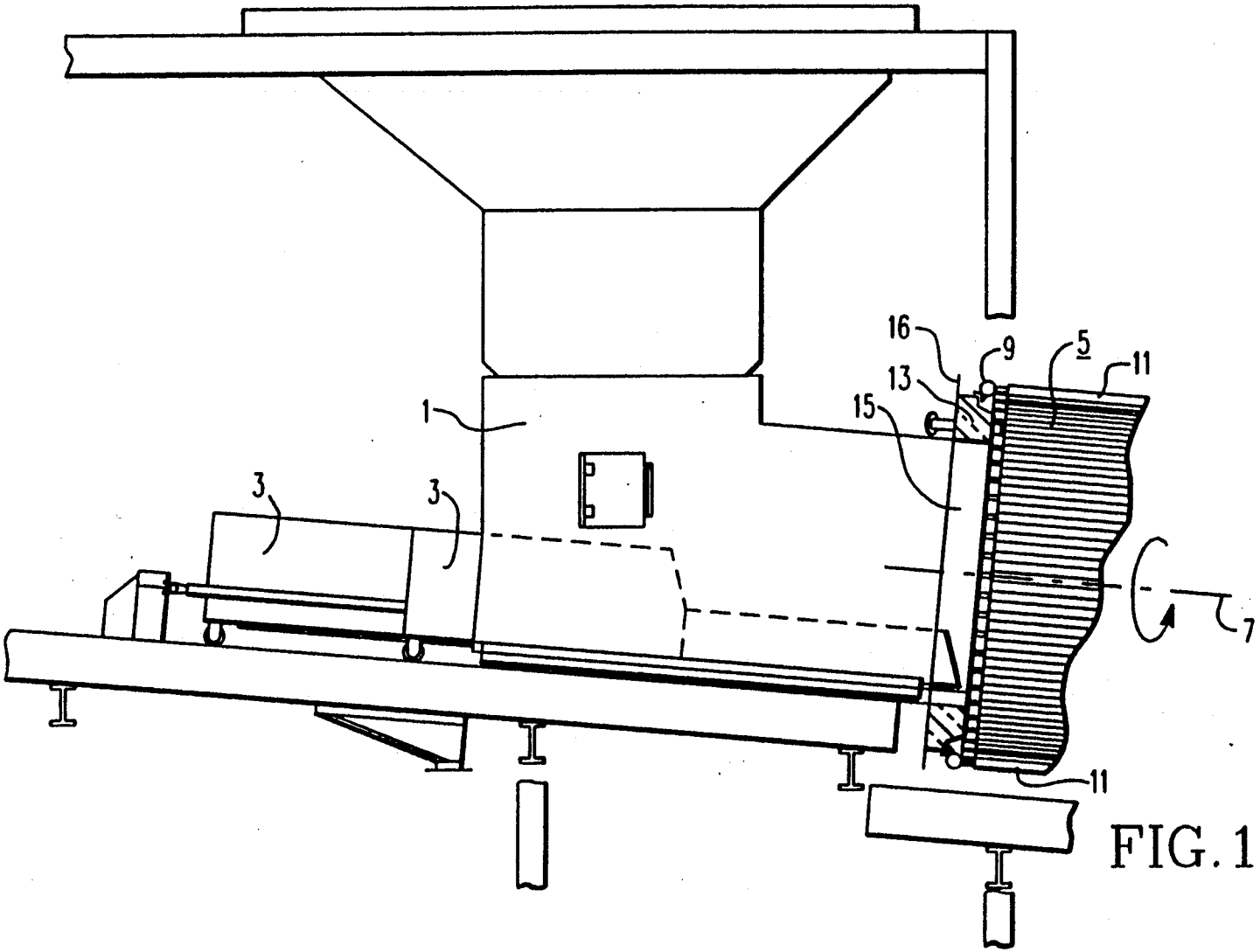
FIG. 1 is a partial sectional view of the inlet end of a rotary combustor for burning municipal solid waste.

Referring now to the drawings in detail and in particular to FIG. 1 there is shown a feed hopper 1 and a pair of parallel rams 3 for feeding municipal solid waste into an inlet end of a rotary combustor 5 of which only a portion thereof is shown in section. The rotary combustor 5 is shown disposed on an inclined axis of rotation 7 and having an inlet end ring header 9 for receiving a plurality of cooling tubes 11 disposed in a cylindrical array. A refractory ring 13 is disposed inboard of the ring header 9 so as to encircle an opening 15 through which municipal waste is pushed into the rotating rotary combustor 5 by the rams 3. The refractory ring 13 is disposed adjacent a rear portion of a housing or shroud 16 enclosing the rotary combustor 5.

Figure 2:
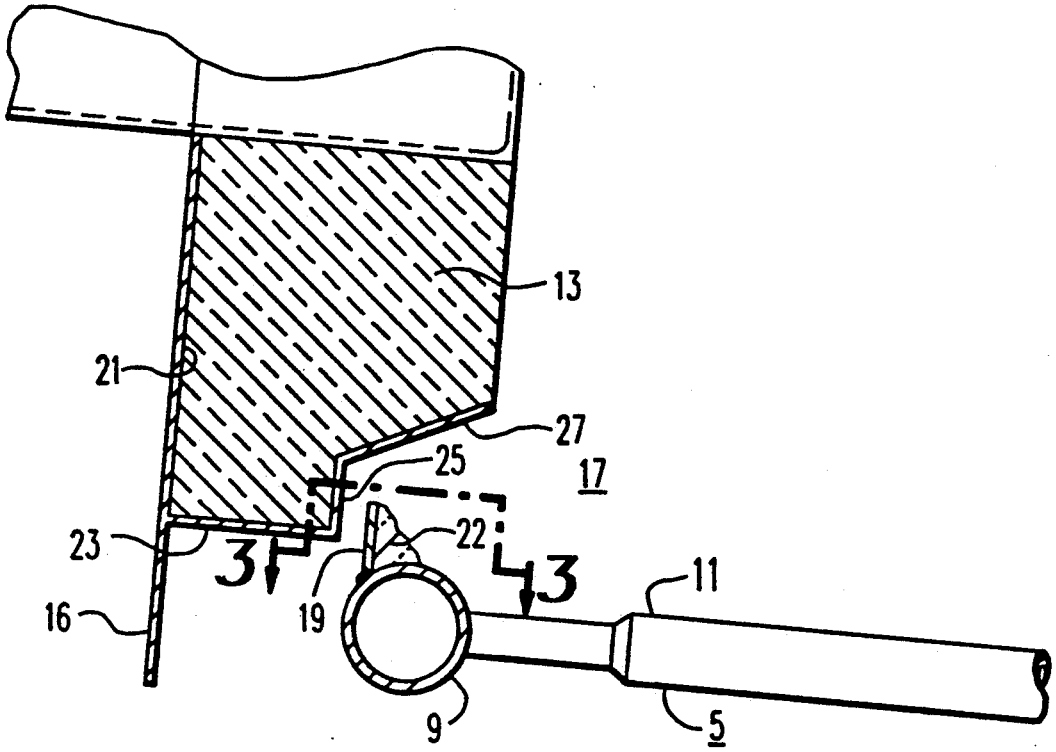
FIG. 2 is an enlarged partial sectional view of an improved seal.
Figure 3:
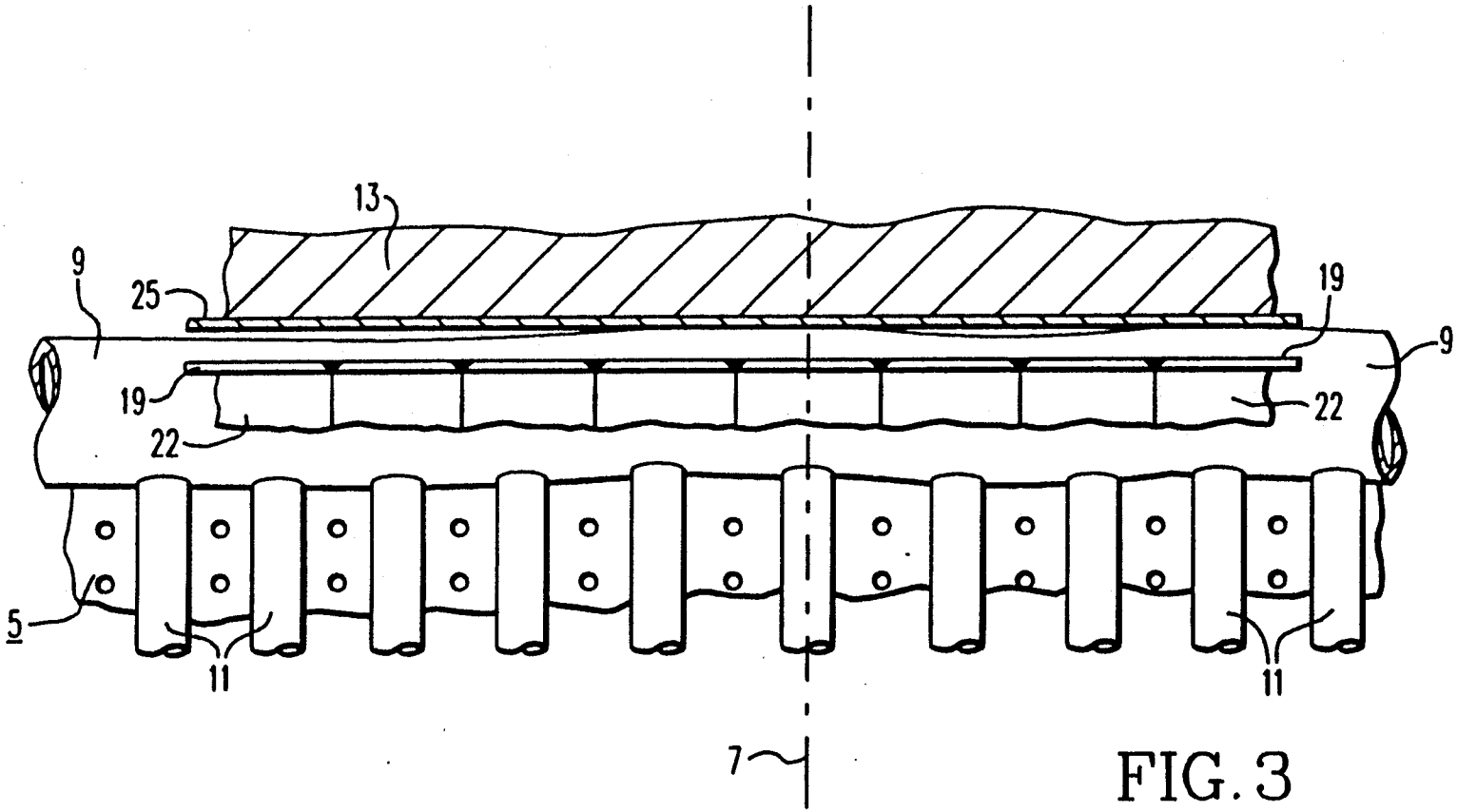
FIG. 3 is a sectional view taken on line 3—3 of FIG. 2 showing a warped ring header and the location of a circumferential segmented bar disposed thereon.

An improved debris tolerant seal 17, as shown in FIGS. 2 and 3, is disposed between the ring header 9 and refractory ring 13 and comprises a segmented circumferential bar 19 extending radially inwardly from the ring header 9. The circumferential bar is installed in arcuate segments with each segment disposed a fixed distance from a surface 21 on the rear portion of the shroud 16 that is in a plane perpendicular to the axis of the rotary combustor 5 so that the circumferential bar generally remains in a fixed plane even though the ring header 9 may be warped and wobbles as the rotary combustor 5 rotates. FIG. 3 shows an exaggerated warped ring header 9. The segments are welded together to form a continuous bar. The distal or radial inner margin of the circumferential bar is shaped or formed in place with a cutting torch so that it is a true circle with its center being on the axis 7 of the rotary combustor 5, this allows for out of roundness and eccentricity of the ring header 9. The circumferential bar 19 also has a ring of castable refractory material 22 disposed on the combustor side of the circumferential bar 19. The castable refractory material 22 is generally so disposed that it is thickest adjacent the ring header 9 and tapers down as it approaches the distal or radially inner margin of the circumferential bar 19. The castable refractory material 22 protects the circumferential bar 19 from the heat generated in the rotary combustor 5.

The refractory ring 13 has a plurality of metal sheathed surfaces. The rear surface of the refractory ring 13 is disposed on the inner surface 21 of the rear portion of the housing or shroud 16 and is generally disposed in a plane perpendicular to the axis of the rotary combustor 5. A metal cylindrical ring surface 23 is disposed generally normal to the surface 21 on the housing or shroud 16 and inboard of the ring header 9, a metal seal surface 25 contiguous with the cylindrical ring surface 23 is disposed to extend radially inwardly and parallel to a plane perpendicular to the axis 7 of the rotary combustor 5, and a metal inclined surface 27 is disposed contiguous with the seal surface 25 and inclined so as to extend radially inwardly and away from the inlet end of the rotary combustor 5. The refractory ring 13 is made of a castable refractory material and once set, the metal surfaces 23, 25 and 27 can waste away due to the high temperature and corrosive environment and the refractory material will be self supporting and sustaining and cooperate with the circumferential bar 19 to maintain a debris tolerant seal.

Figure 4:
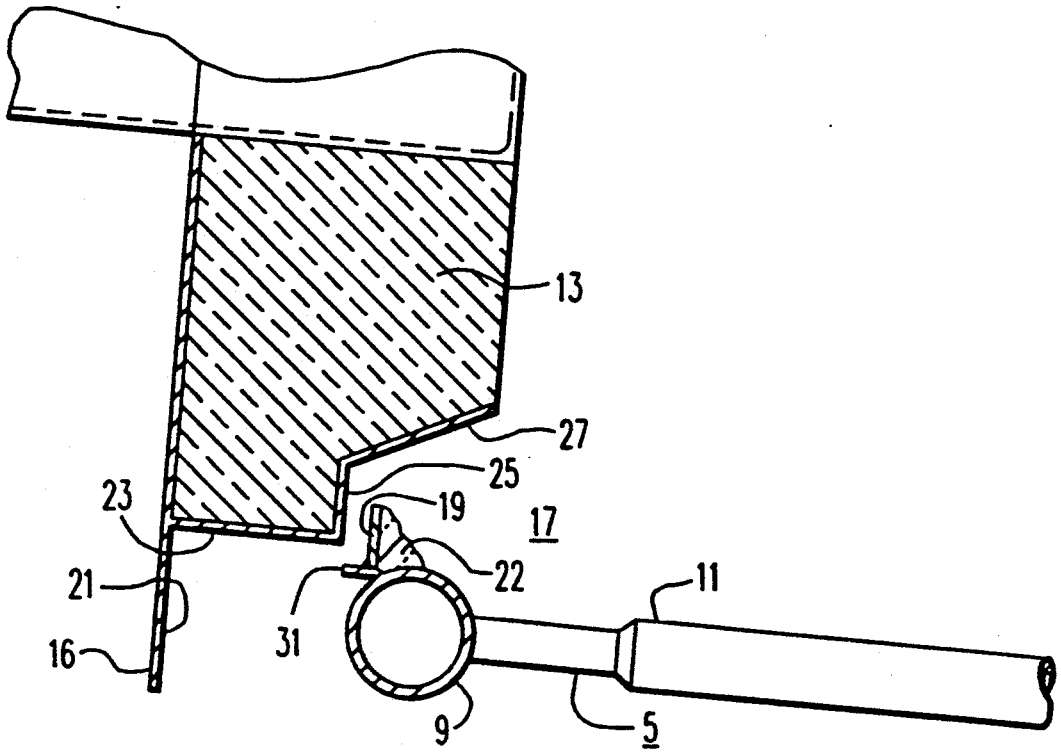
FIG. 4 is an enlarged partial sectional view of an alternative improved seal, which has a protective layer of refractory to reduce thermal distortion.

As shown in FIG. 4, the improved debris tolerant seal 17 can be installed by welding the circumferential bar 19 to an old seal ring 31 herebefore installed. The advantage of this arrangement is a code qualified welder is not required as the weld is not to the ring header, which is a pressure vessel or pipe and the codes require that only code qualified welders make such welds.

The improved debris tolerant seal 17 will not become jammed by waste material; provides for out of roundness, eccentricity and axial and radial thermal expansion; has no machined parts; is inexpensive and is easily installed on new or existing rotary combustors 5.

While the preferred embodiments described herein set forth the best mode to practice this invention presently contemplated by the inventors, numerous modifications and adaptations of this invention will be apparent to others skilled in the art. Therefore, the embodiments are to be considered as illustrative and exemplary and it is understood that the claims are intended to cover such modifications and adaptations as they are considered to be within the spirit and scope of this invention.

What is claimed:

1. An improved debris tolerant seal between a refractory ring and a ring header disposed at an inlet end of a rotary combustor which rotates about an inclined axis and in which municipal solid waste is burned, said seal comprising a circumferential bar attached to and extending radially inwardly from the ring header, the circumferential bar is made up of a plurality of segments, each of said segments being disposed parallel to a plane perpendicular to the axis of the rotary combustor, the refractory ring having a pair of outer sheathed surfaces adjacent the circumferential bar, one of the sheathed surfaces being parallel to and spaced from the circumferential bar and the other sheathed surface being contiguous with the one sheathed surface and inclined so as to extend radially inwardly and away from said inlet end of said combustor, and away from said circumferential bar whereby large pieces of debris are prevented from entering the space between the one sheathed surface and the circumferential bar a small debris can pass therebetween, the circumferential bar having a refractory material disposed on the combustor side thereof to prevent the circumferential bar from burning out.

2. The improved debris tolerant seal of claim 1, wherein the refractory material is thickest where the circumferential bar contacts the ring header and tapers inwardly toward the radial inner margin of the circumferential bar.

3. The improved debris tolerant seal of claim 1, wherein the ring header has a flat cylindrical ring which extends axially therefrom and the circumferential bar is welded to the flat ring.

4. The improved debris tolerant seal of claim 1, wherein refractory ring has a third sheathed surface contiguous with the one sheathed surface and forming an axially disposed cylindrical ring.

5. The improved debris tolerant seal of claim 1, wherein the circumferential bar has a radially inner margin forming a circle the center of which is on the axis of the rotary combustor.

* * * * *